United States Patent [19]

Michaelsen

[11] Patent Number: 4,593,902

[45] Date of Patent: Jun. 10, 1986

[54] EXERCISE DEVICE

[76] Inventor: Randolph C. H. Michaelsen, 2168 Mt. Shasta Dr., San Pedro, Calif. 90731

[21] Appl. No.: 639,453

[22] Filed: Aug. 10, 1984

[51] Int. Cl.[4] ..... A63B 23/00

[52] U.S. Cl. ..... 272/93; 272/900; 206/579; 206/315.1

[58] Field of Search ..... 272/93, 109, 145, 900, 272/DIG. 5, 142; 206/315.1, 579, 226; 273/286, 84 R, 84 A; 235/105

[56] References Cited

U.S. PATENT DOCUMENTS

| | | | |
|---|---|---|---|
| 2,741,360 | 4/1956 | Harrowe | 206/579 X |
| 3,643,943 | 2/1972 | Erwin, Jr. et al. | 272/69 |
| 4,007,931 | 2/1977 | Wich et al. | 273/84 A |
| 4,060,240 | 11/1977 | Dunston | 272/900 X |
| 4,121,825 | 10/1978 | Hult | 272/93 |
| 4,262,898 | 4/1981 | Lee | 272/68 |
| 4,337,938 | 7/1982 | Rodriguez | 272/93 |

FOREIGN PATENT DOCUMENTS

| | | | |
|---|---|---|---|
| 164848 | 9/1958 | Sweden | 272/75 |
| 942707 | 11/1963 | United Kingdom | 272/900 |

*Primary Examiner*—Richard J. Apley
*Assistant Examiner*—David J. Brown
*Attorney, Agent, or Firm*—Christie, Parker & Hale

[57] ABSTRACT

An exercise device having a container formed from two mated halves releasably connected to one another and a flexible strap ending in loops capable of encircling one of the container halves which thereby provides a convenient, lightweight foot restraint, easily stored and quickly assembled for use in performing sit-ups in the home or in the office is disclosed.

3 Claims, 3 Drawing Figures

EXERCISE DEVICE

FIELD OF THE INVENTION

The present invention pertains to an exercise device and, more particularly, to a device which aids in the performance of sit-ups by providing a convenient and easily stored foot restraint.

BACKGROUND OF THE INVENTION

Sit-ups are a form of exercise that is excellent for trimming and firming stomach muscles. For best results they should be performed in a smooth, rythmic motion, without jerking, and the shoulder blades should not touch the floor at the end of the down stroke nor should the upper body be brought to a fully vertical position at the end of the up stroke. When executed in this manner, a continuous uninterrupted tension is maintained on the stomach muscles.

To accomplish this, however, it is necessary for a person's feet to be restrained during exercising. This has meant that sit-ups could not conveniently be performed to best advantage unless another person was available to hold down the exerciser's feet or unless exercise equipment, such as that found in a gym, was readily available. Accordingly, a need exists for a conveninent and lightweight foot restraint which can be easily stored and then quickly assembled for use in performing sit-ups in the home or office.

SUMMARY OF THE INVENTION

In accordance with the invention, there is provided an exercise device having a container formed from two mated halves releasably connected to one another and a flexible strap which has a loop at each end, each loop being capable of encircling either one of the container halves. The flexible strap is long enough so that when it is placed in a U-shaped configuration with the loops, each holding one of the disconnected container halves and positioned against one side of a door and the central portion of the strap extending underneath the door to the other side, a person can place his feet up under the central portion of the strap and have them held in position while exercising. When removed from the container halves, the strap can be fitted within the container for storage. In a particularly preferred embodiment, the exercise device has a counter means responsive to tension placed on the strap which will register one count every time tension is placed on the strap and a timer means, preferably removably attached to the strap for timing exercise periods.

BRIEF DESCRIPTION OF THE DRAWINGS

These and other features and advantages of the present invention will become better understood by reference to the following detailed description when considered in conjunction with the accompanying drawings, wherein.

DETAILED DESCRIPTION

Figure 1:
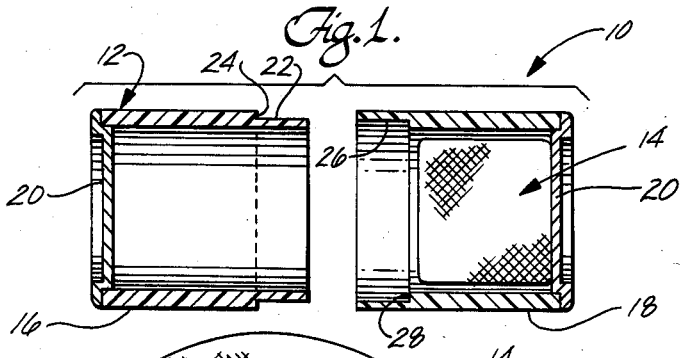
FIG. 1 is a partially cut-away side view of an exercise device according to the present invention in its storage position.

With reference to FIG. 1, an exercise device 10 has as its primary components a hollow, generally cylindrical container tube 12 and a flexible and substantially inelastic belt or strap 14.

The container tube, which is preferably made of a sturdy but lightweight material such as cardboard or plastic, is divided into a pair of mated half tubes 16 and 18. At the outer end of each half tube, a thin end cap 20 is attached to close off the central opening. Each end cap is preferably made of a sturdy material such as metal or plastic. Adjacent to the inner end of half tube 16 is an external recess 22 which encircles the outer surface of half tube 16 and extends back toward the outer end of the half tube until terminating at an axial, external shoulder 24. Similarly, adjacent to the inner end of half tube 18 is an internal recess 26 which encircles the inner surface of half tube 18 and extends back toward the outer end of the half tube until terminating in an axial, internal shoulder 28. These recesses are dimensioned so that the two half tubes can be slid together to form a closed container. Strap 14 can be rolled up and stored within this container, as shown in FIG. 1, until the exercise device is to be used.

Figure 2:
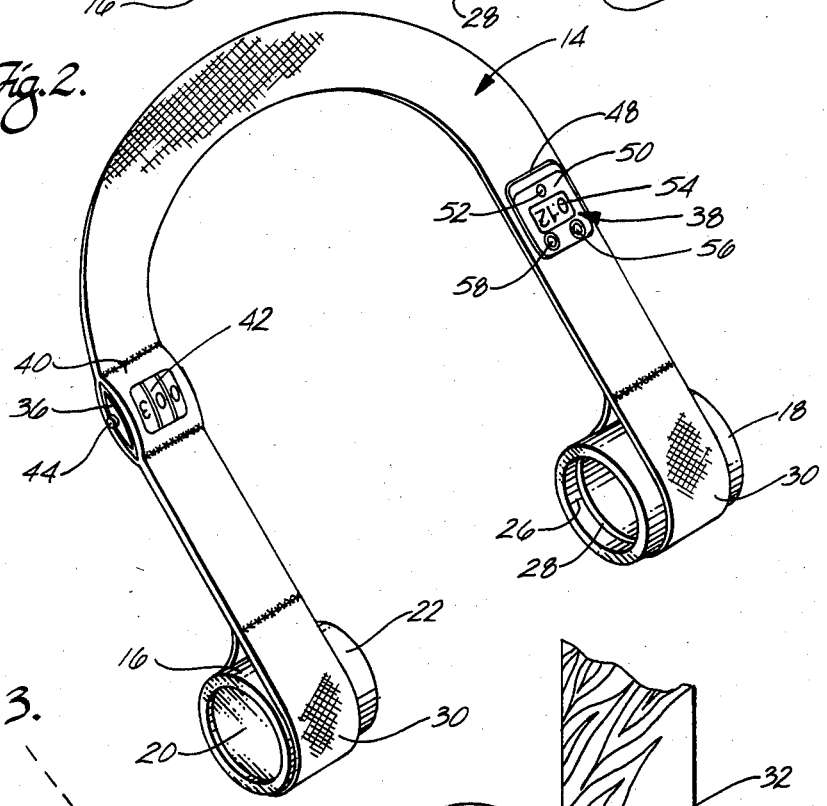
FIG. 2 is a pictorial view of the exercise device of FIG. 1 assembled for use.

To assemble the exercise device for use, strap 14, which is preferably made of a sturdy flexible material such as nylon or polypropylene webbing, is removed from container tube 12 and unrolled. As shown in FIG. 2, the strap has a loop 30 at each of its ends formed by looping the ends back on themselves and then attaching them to the strap by sewing or other suitable method. Half tubes 16 and 18 can now be slid into these loops, which are dimensioned so that they will encircle and snugly grip the outer surface of each respective half tube.

Figure 3:
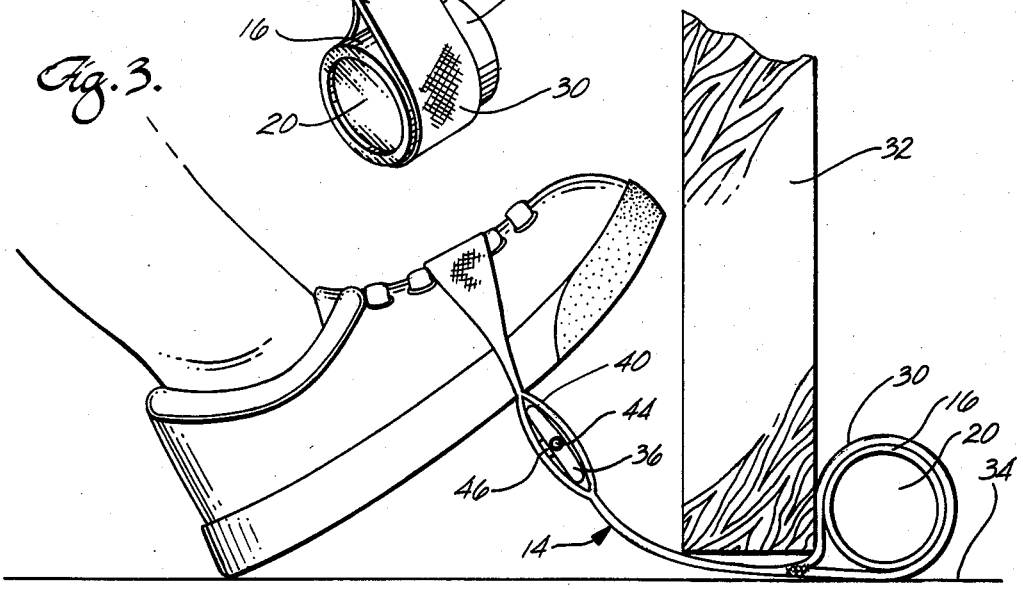
FIG. 3 is a side view of the exercise device of FIG. 1 in use.

To use the exercise device, it is only necessary to find a nearby door 32. The door is opened and strap 14, positioned in a U-shaped configuration (FIG. 2), is slid sideways underneath the door along the space left between the bottom of the door and the floor 34. When the door is then closed, the loops containing the half tubes should both be on one side of the door with the central portion of strap 14 sticking out on the other side of the door. By pulling this central portion outward until the loops containing the half tubes are tight against the opposite side of the door, enough space is available for an exerciser to put his feet up under the central portion of the strap 14 with the strap generally across the tops of the instep portions of his feet. The exerciser's feet are then held in place by the strap while the sit-ups are done (FIG. 3).

Some exercisers will also wish to check their aerobic fitness by counting the number of sit-ups done in a specific amount of time. For this reason, the preferred embodiment has associated with it a counter 36 and a timer 38. The counter is attached to one surface of strap 14 by a front strap 40 which stretches over the counter and is sewn or otherwise affixed to strap 14 on either side of the counter. Front strap 40 has an aperture or a transparent window 42 in its center through which the counter reading can be seen. The counter has a reset button 44 which sticks out to one side between front strap 40 and strap 14. A spring-biased counter actuator 46 is at the bottom of the counter facing the surface of strap 14 (FIG. 3). When an exerciser puts tension on strap 14 during the up stroke, the actuator will be forced inward to register one sit-up. Between successive sit-ups, there will be an interval in which little or no tension will be applied to the strap, and it is in this interval that the spring-biased actuator 46 of the counter returns to its unactuated position to be depressed during the following sit-up in response to tension in the strap. The counter is positioned to one side of the central portion of strap 14 so that it will be on the same side of the door as the exerciser when the exercise device is in use.

Positioned at a corresponding location at the other side of the central portion of strap 14 and attached to the same surface of strap 14 as the counter is a cloth pocket 48 into which timer 38 can be placed. The pocket has a front flap 50 which is secured by a snap 52. The pocket and front flap have a transparent window 54 in their center through which the timer reading can be seen. In addition, there are two holes in the front flap and pocket through which a stop/start button 56 and a reset button 58 for the timer can extend. In this way, the timer can be operated by the exerciser while it is still in pocket 48 or the exerciser can remove the timer from pocket 48 to hold in his hand during exercising.

The exercising device is structurally simple and can be housed in a compact container which also functions as a part of the device in use. The exercising device, being compact, can be readily packed in luggage to be used to advantage by a business or pleasure traveller.

While the timer and counter as presently configured form the presently preferred embodiment, it is to be understood that other configurations conveniently associating a timer and a counter with the exercise device are contemplated.

What is claimed is:

1. An exercise device comprising an elongate flexible strap member of selected length defining at each of a pair of opposite ends a loop of selected inner girth, a pair of cylindrical members sized in diameter to be snugly, yet removably received in a corresponding one of the strap member end loops and to be sufficiently large to prevent their passage between the bottom of a door and an adjacent floor surface, the strap member being sufficiently long between its end loops that when the cylindrical members are present in the end loops and the center portion of the strap between the ends is passed below a door from one side of the door and the enlooped cylindrical members abut against the one side of the door, there is provided on the other side of the door a loop of the strap member into which a person can comfortably yet relatively snugly place his feet with the loop generally engaged with the instep portions of the feet, whereby the device in cooperation with the door serves as a foot hold-down for aiding in the performance of sit-ups and similar exercises, the cylindrical members being hollow with sufficient space therein to receive the strap and each having at least one opend end, one open end of one cylindrical member being matable with one open end of the other cylindrical member to define a container for the strap member.

2. An exercise device comprising an elongate flexible strap member of selected length defining at each of a pair of opposite ends a loop of selected inner girth, a pair of cylindrical members sized in diameter to be snugly received in a corresponding one of the strap member end loops and to be sufficiently large to prevent their passage between the bottom of a door and an adjacent floor surface, the strap member being sufficiently long between its end loops that when the cylindrical members are present in the end loops and the center portion of the strap between the ends is passed below a door from one side of the door and the enlooped cylindrical members abut against the one side of the door, there is provided on the other side of the door a loop of the strap member into which a person can comfortably yet relatively snugly place his feet with the loop generally engaged with the instep portions of the feet, whereby the device in cooperation with the door serves as a foot hold-down for aiding in the performance of sit-ups and similar exercises, the cylindrical members being hollow and each having at least one open end, one open end of one cylindrical member being matable with one open end of the other cylindrical member to define a container for the strap member, and a counter coupled to the strap member adjacent the center thereof for operation in response to tension in the strap member.

3. An exercise device comprising an elongate flexible strap member of selected length defining at each of a pair of opposite ends a loop of selected inner girth, a pair of cylindrical members sized in diameter to be snugly received in a corresponding one of the strap member end loops and to be sufficinetly large to prevent their passage between the bottom of a door and an adjacent floor surface, the strap member being sufficiently long between its end loops that when the cylindrical members are present in the end loops and the center portion of the strap between the ends is passed below a door from one side of the door and the enlooped cylindrical members abut against the one side of the door, there is provided on the other side of the door a loop of the strap member into which a person can comfortbly yet relatively snugly place his feet with the loop generally engaged with the instep portions of the feet, whereby the device in cooperation with the door serves as a foot hold-down for aiding in the performance of sit-ups and similar exercises, and a counter coupled to the strap member adjacent the center portion thereof for operation in response to tension in the strap member.

* * * * *